US007690965B2

(12) United States Patent
Falla et al.

(10) Patent No.: US 7,690,965 B2
(45) **Date of Patent: *Apr. 6, 2010**

(54) METHODS OF MAKING COTTON BLEND GLUE BRASSIERES

(75) Inventors: Gloria Falla, Demarest, NJ (US); Roger Warren, Statesville, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 1251 days.

This patent is subject to a terminal disclaimer.

(21) Appl. No.: 10/611,682

(22) Filed: Jul. 1, 2003

(65) Prior Publication Data

US 2004/0106354 A1 Jun. 3, 2004

Related U.S. Application Data

(63) Continuation-in-part of application No. 09/777,801, filed on Feb. 6, 2001, now Pat. No. 6,837,771.

(60) Provisional application No. 60/392,988, filed on Jul. 1, 2002.

(51) Int. Cl.
*A41C 3/00* (2006.01)

(52) U.S. Cl. ..... 450/92; 450/93; 450/39

(58) Field of Classification Search ..... 450/39, 450/1, 41, 46, 47, 49, 51, 52.57, 92–94, 97, 450/109, 114–118, 122–124, 156; 2/69, 2/113, 78.1–78.4, 73, 400–408, 243.1; 604/385.01–396; 83/13–16, 23, 30, 32, 39, 40, 50–55, 936–941; 156/245, 73.1, 60, 73.3, 73.4, 88; 264/152–155, 264/157, 257, 258, 291–294, 320, 321, 163, 264/145, 148, 160

See application file for complete search history.

(56) References Cited

U.S. PATENT DOCUMENTS

| | | | | |
|---|---|---|---|---|
| 2,126,833 | A | 8/1938 | Steinberger | |
| 2,524,620 | A | 1/1950 | Cadous | |
| 2,524,621 | A | 1/1950 | Cadous | |
| 2,692,389 | A | 10/1954 | Lamkin et al. | |
| 2,915,067 | A * | 12/1959 | Bracht | 450/45 |
| 2,954,031 | A | 9/1960 | Froehlich | |
| 3,064,329 | A | 11/1962 | Westberg | |
| 3,070,870 | A | 1/1963 | Alexander et al. | 450/39 |
| 3,101,717 | A | 8/1963 | Korman | |

(Continued)

FOREIGN PATENT DOCUMENTS

| | | |
|---|---|---|
| CN | 1232652 | 4/1998 |
| DE | 200 11 261 | 2/2001 |
| DE | 199 42 996 | 3/2001 |
| EP | 604 812 A1 | 12/1993 |
| EP | 734 660 | 10/1996 |
| EP | 0852 915 A2 | 7/1998 |
| EP | 875 612 | 11/1998 |

(Continued)

*Primary Examiner*—Gloria Hale
(74) *Attorney, Agent, or Firm*—Womble Carlyle Sandridge & Rice, PLLC

(57) ABSTRACT

A method of forming an undergarment is provided. The method includes inserting an adhesive layer between a first fabric layer and a second fabric layer to form a fabric sub-assembly, the sub-assembly having a periphery that is larger than an outer periphery of the undergarment; causing the adhesive layer to form a laminate from the sub-assembly; and removing a trim from the laminate at the outer periphery to form a finished edge of the undergarment, wherein the first and second fabric layers comprise at least one cotton material.

23 Claims, 4 Drawing Sheets

U.S. PATENT DOCUMENTS 3,114,374 A 12/1963 Chalfin
3,225,768 A 12/1965 Galitzki et al.
3,266,495 A 8/1966 Sachs
3,320,346 A 5/1967 Galitzki et al.
3,327,707 A 6/1967 Storti
3,383,263 A 5/1968 Storti
3,497,415 A 2/1970 Adachi
3,502,083 A 3/1970 Howard et al.
3,725,954 A 4/1973 Baldini
3,726,286 A 4/1973 Wolfson
3,799,174 A 3/1974 Howard
3,881,041 A 4/1975 Glienke
3,939,023 A 2/1976 Magidson et al.
3,947,207 A 3/1976 Magidson et al.
3,998,231 A 12/1976 Delet
4,080,416 A 3/1978 Howard ..... 264/258
4,090,900 A 5/1978 Jacaruso et al.
4,135,025 A 1/1979 Backes
4,148,322 A 4/1979 Jacaruso et al.
4,172,002 A 10/1979 Gluckin
4,184,494 A 1/1980 King, Jr.
4,185,332 A * 1/1980 Jahnig ..... 623/7
4,202,853 A 5/1980 Di Tullio ..... 264/160
4,214,319 A 7/1980 Bollag
4,244,249 A 1/1981 Di Tullio ..... 83/52
4,248,923 A 2/1981 Ciobanu et al.
4,261,366 A 4/1981 Lamborn
4,372,321 A 2/1983 Robinson ..... 450/39
4,375,445 A 3/1983 Cole et al. ..... 264/258
4,419,997 A 12/1983 Cole
4,481,951 A 11/1984 Cole et al. ..... 156/245
4,557,267 A 12/1985 Cole
4,572,195 A 2/1986 Hyams
4,604,152 A 8/1986 Liukko
4,701,964 A 10/1987 Bell et al.
4,767,377 A 8/1988 Falla
4,776,916 A 10/1988 Prunesti et al.
4,795,400 A 1/1989 Greenberg
4,861,409 A 8/1989 Hashda et al.
4,895,751 A 1/1990 Kato et al.
4,957,466 A 9/1990 Hopps
5,092,812 A 3/1992 Babcock
5,154,659 A * 10/1992 Gluckin ..... 450/39
5,165,113 A 11/1992 Hyams et al.
5,240,538 A 8/1993 Hyams
5,359,732 A 11/1994 Waldman et al.
5,385,502 A 1/1995 Moretz et al.
5,406,646 A 4/1995 Balit et al.
5,426,791 A 6/1995 Sydor et al.
5,442,818 A 8/1995 Loos
5,447,462 A 9/1995 Smith et al.
5,479,791 A 1/1996 Osborne
5,487,189 A 1/1996 Bell
5,507,681 A 4/1996 Smith et al.
5,539,931 A 7/1996 Fizer et al.
5,553,468 A 9/1996 Osborne
5,590,548 A 1/1997 Osborne
5,592,836 A 1/1997 Schuster
5,605,060 A 2/1997 Osborne
5,611,722 A 3/1997 Osborne
5,614,303 A 3/1997 Baigas, Jr.
5,787,512 A 8/1998 Knox
5,790,983 A 8/1998 Rosch et al.
5,814,003 A 9/1998 Knox
5,816,889 A 10/1998 Fildan
5,820,443 A * 10/1998 Burr ..... 450/40
5,820,445 A 10/1998 Smith et al.
5,873,768 A 2/1999 Fleischman-Ament et al.
5,907,872 A 6/1999 Alberts et al.
5,916,829 A 6/1999 Girard et al.
5,938,500 A 8/1999 Hampton
5,946,944 A 9/1999 Osborne
5,953,754 A 9/1999 Rosch et al.
5,983,394 A 11/1999 Joo
5,984,762 A 11/1999 Tedeschi et al.
6,000,994 A 12/1999 Salotto
6,018,819 A 2/2000 King et al.
6,023,789 A 2/2000 Wilson et al.
6,048,253 A 4/2000 Larsen
6,076,186 A 6/2000 Grose
6,079,050 A 6/2000 Hooper-Jackson
6,083,080 A 7/2000 Lawson et al.
6,115,847 A 9/2000 Rosch et al.
6,125,664 A 10/2000 Browder
6,134,718 A 10/2000 Sesselmann
6,162,111 A 12/2000 Heroff
6,178,784 B1 1/2001 Marley
6,179,687 B1 1/2001 Lee et al.
6,192,521 B1 2/2001 Alberts et al.
6,192,717 B1 2/2001 Rabinowicz
6,287,168 B1 9/2001 Rabinowicz
6,306,006 B1 10/2001 Cheng
6,336,840 B2 1/2002 Heroff
6,364,741 B1 4/2002 Ferguson
6,398,620 B1 6/2002 Huang
6,401,786 B1 6/2002 Tedeschi et al.
6,402,586 B1 * 6/2002 Winik et al. ..... 450/78
6,425,800 B1 7/2002 Huang
6,431,945 B1 8/2002 Stephens et al.
6,431,947 B1 8/2002 Henz
6,645,040 B2 11/2003 Rabinowicz et al. ..... 450/1
6,837,771 B2 * 1/2005 Falla ..... 450/39
2001/0000164 A1 4/2001 Heroff
2002/0000684 A1 1/2002 Nakanishi
2002/0002023 A1 1/2002 Nakanishi
2002/0023709 A1 2/2002 Tedeschi et al.
2002/0031978 A1 3/2002 Heroff
2002/0106970 A1 8/2002 Falla
2002/0111119 A1 8/2002 Johnson et al.
2002/0155785 A1 10/2002 del Olmo
2002/0155786 A1 10/2002 Querquant
2003/0013379 A1 1/2003 Henz
2003/0092355 A1 5/2003 Rabinowicz ..... 450/1

FOREIGN PATENT DOCUMENTS

EP 1 033 084 9/2000
EP 1 123 666 8/2001
FR 1.362.777 4/1964
FR 2 487 734 2/1982
FR 01282812 2/1995
FR 2 782 611 3/2000
FR 2 785 154 5/2000
FR 2 792 173 10/2000
FR 2 820 001 8/2001
FR 2 823 075 10/2002
GB 1 237 196 6/1971
GB 1 348 132 3/1974
GB 1 470 928 4/1977
GB 2 265 077 9/1993
IT N. 01282812 6/1995
JP 9031856 2/1997
JP 2000226703 8/2000
JP 2000314011 11/2000
JP 2001073203 3/2001
JP 2002155403 4/2002
JP 2002201505 7/2002
WO WO 98/43503 10/1998
WO WO 01/85516 2/2001
WO WO 01/21019 3/2001
WO WO 02/07548 1/2002

* cited by examiner

METHODS OF MAKING COTTON BLEND GLUE BRASSIERES

CROSS REFERENCE TO RELATED APPLICATIONS

This application claims priority to U.S. Provisional Application Ser. No. 60/392,988 filed on Jul. 1, 2002, the content of which is incorporated herein by reference. In addition, this application is a continuation-in-part of U.S. application Ser. No. 09/777,801 filed on Feb. 6, 2001 now U.S. Pat. No. 6,837,771, the content of which is incorporated herein by reference.

BACKGROUND OF THE INVENTION

1. Field of the Invention

The present invention relates to brassieres. More particularly, the present invention relates to methods of making cotton blend glue brassieres. Such brassieres include a finished edge that does not require separate binding or narrow edge finishing.

2. Description of Related Art

It is well known that the comfortability of wearing of a brassiere is improved when the brassiere is made of a material that is soft and supple, yet capable of providing shape and control to support the breasts of the wearer. Natural fabrics, such as cotton, and blends of natural and synthetic fabrics, such as cotton, polyester and spandex, are a popular choice for making brassieres. These fabrics are soft and flexible, yet they shape and contour the breasts of the wearer. The comfortability of a brassiere is also improved when a brassiere does not have seams or elastic bands that may "dig in" and constrict the blood flow in the torso area of the wearer.

Advances have been made in the use of adhesives to bind fabrics. However, prior laminates bind natural fibers, such as cotton, together in such a manner as to "lock up" the fibers, and, thus, prevent the laminates from stretching. As a result, such brassieres still require several finishing steps in order to complete the manufacturing of the brassiere. Such finishing steps include the addition of binding materials, such as elastic, to provide support, stretch, and a finished edge.

Given the foregoing, there is a need for methods of making brassieres made of a material that is soft and supple, yet is capable of providing shape and control to support the breasts of the wearer, without seams or elastic.

SUMMARY OF THE INVENTION

It is an object of the present invention to provide a method of forming a cotton blend brassiere from a multi-layered fabric laminate.

It is a still another object of the present invention to provide such a method where the brassiere has a finished edge that does not require separate binding or narrow edge finishing.

These and other objects and advantages of the present invention are achieved by a method of forming an undergarment. The method includes inserting an adhesive layer between a first fabric layer and a second fabric layer to form a fabric sub-assembly. The sub-assembly has a periphery that is larger than an outer periphery of the undergarment. The method further includes causing the adhesive layer to form a laminate from the sub-assembly and removing a trim from the laminate at the outer periphery to form a finished edge of the undergarment. Preferably, the first and second fabric layers include at least one cotton material.

These and other objects and advantages of the present invention are also achieved by a method including applying an adhesive layer to a first fabric layer; overlying the adhesive layer with a second fabric layer; causing the adhesive layer to bond the first and second fabric layers together to form a stretchable laminate; and cutting the stretchable laminate along the outer periphery to form a finished edge of the undergarment that resists unraveling. The stretchable laminate has a periphery that is larger than an outer periphery of the undergarment. Preferably, the first fabric layer is a first cotton blend fabric and the second fabric layer is a second cotton blend fabric.

Still further, these and other objects and advantages of the present invention are achieved by a method including forming an adhesive layer having an adhesive-free portion; surrounding the adhesive layer with a first fabric layer and a second fabric layer; causing the adhesive layer to bond the first and second fabric layers together to form a stretchable laminate; and cutting the stretchable laminate along the outer periphery to form a finished edge of the undergarment that resists unraveling. The adhesive layer is a layer of thermally actuated polyethylene and ethylene vinyl acetate copolymer. The stretchable laminate having a periphery that is larger than an outer periphery of the undergarment.

The above-described and other features and advantages of the present invention will be appreciated and understood by those skilled in the art from the following detailed description, drawings, and appended claims.

DETAILED DESCRIPTION OF THE INVENTION

Figure 1:
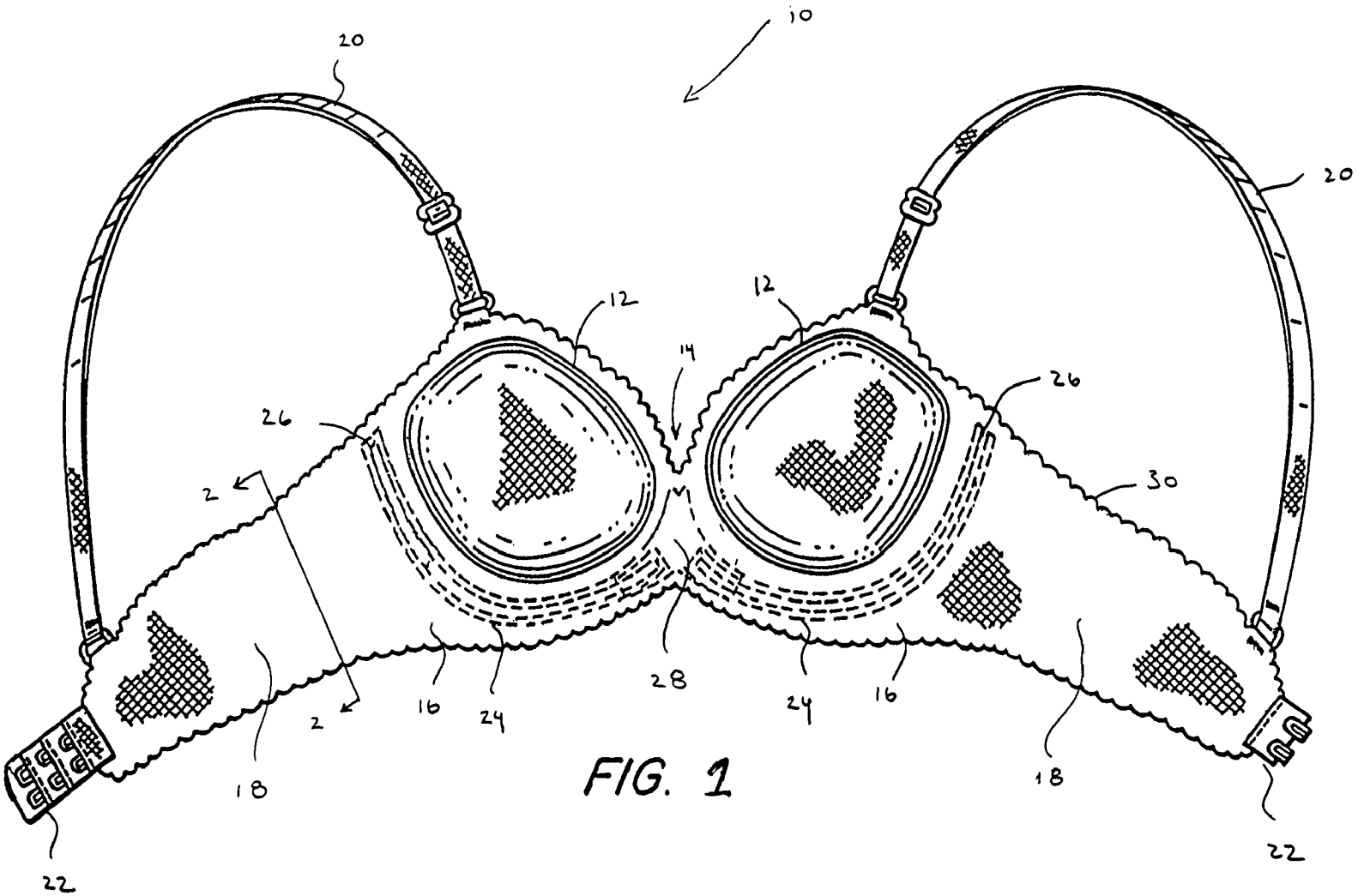
FIG. 1 is a top plan view of an exemplary embodiment of a brassiere according to the present invention.

Referring to the drawings, and, in particular, FIG. 1, there is provided a brassiere according to the present invention, generally represented by reference numeral 10. Brassiere 10 includes a pair of breast cups 12 that can be readily molded into a three dimensional cup shape, a central portion 14 extending between the breast cups; a bottom portion 16 that can lie flat against the chest wall of a wearer beneath the cups; and a pair of side panels 18 that extend from the breast cups 12 and provide a body circling arrangement. Preferably, brassiere 10 has a pair of shoulder straps 20 and a set interconnecting clasps 22.

Brassiere 10 can preferably have a pair of underwire channels 24 provided therein to receive a pair of underwires 26. Each underwire 26 is preferably an arcuate, U-shaped member. Each channel 24 is typically stitched to brassiere 10. However, each channel 24 may be glued or ultrasonically welded to brassiere 10. Each channel 24 may be made from cotton, polyester or spandex.

Brassiere 10 can also include a central gore 28 to reinforce central portion 14 and provide additional separation between breast cups 12. Preferably, central gore 28 is made from a non-stretchable material, such as cotton, polyester or nylon. More preferably, central gore 28 is made from 100 percent cotton.

Further, brassiere 10 includes a finished edge 30 defined about the periphery of the brassiere. Finished edge 30 can be a straight edge, a scalloped edge, and any combination of the foregoing. Preferably, finished edge 30 has a decorative pattern such as the scalloped pattern illustrated in FIG. 1.

Figure 2:
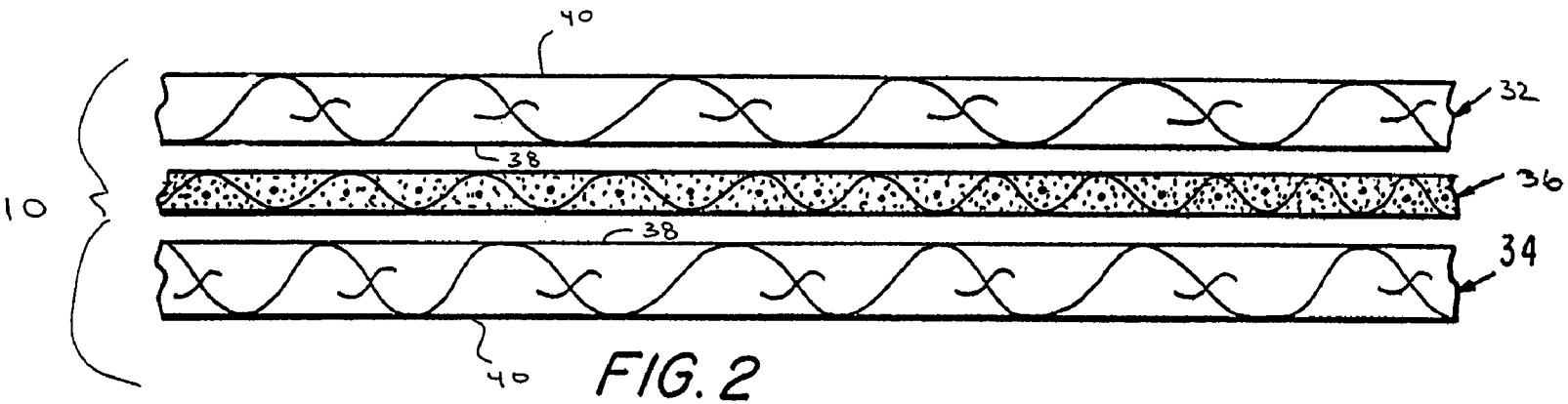
FIG. 2 is an exploded sectional view taken along line 2-2 of FIG. 1.

Brassiere 10 is, preferably, a fabric laminate of two or more layers as illustrated in FIG. 2. Thus, brassiere 10 has a first layer 32 and a second layer 34 adhered to one another by an adhesive layer 36. First and second layers 32, 34 each have a inner surface 38 and an outer surface 40. Depending upon the construction of the brassiere, adhesive layer 36 may be applied to cover inner surface 38 of first and second layers 32, 34 entirely or only over selected portions of the inner surfaces.

For example, it is contemplated by the present invention for adhesive layer 36 to cover only selected regions of inner surfaces 38 so that an adhesive free region 42 of the adhesive layer is defined. Adhesive free region 42 is illustrated in phantom in FIG. 3 and, thus, can form a non-bonded region (not shown) between first and second layers 32, 34. Preferably, adhesive free region 42 is defined at breast cups 12 so that first and second layers 32, 34 have the non-bonded region in the breast cups 12.

First layer 32 and second layer 34 are made from natural fibers or blend of natural and synthetic fibers. Preferably, first layer 32 and second layer 34 are made of a blend of cotton, polyester and spandex. More preferably, first layer 32 and second layer 34 are made of a blend having approximately 44% to 50% cotton, approximately 44% to 50% polyester and approximately 3% to 9% spandex. Even more preferably, first layer 32 and second layer 34 are made of a blend having 47% cotton, 47% polyester and 6% spandex.

Adhesive layer 36 is a thermoplastic adhesive. Preferably, adhesive layer 36 is a thermally actuated polyethylene and ethylene vinyl acetate copolymer. More preferably, adhesive layer 36 is a thermally actuated polyethylene and ethylene vinyl acetate copolymer that is sold under the trade name Delnet® EP by Delstar Technologies, Inc. Delnet® EP is made from high density polyethylene (HDPE) with an EVA skin layer on both sides to enable easier bonding. Adhesive layer 36 has a base weight of approximately 0.45 oz/yd$^2$; a thickness of approximately 5.5 mils; a material direction (MD) boss count of approximately 24 per inch; a course direction (CD) boss count of approximately 25 per inch; a porosity of approximately 1000 cfm/ft$^2$; an MD tensile strength of approximately 2.4 lbs/in; a CD tensile strength of approximately 4.0 lbs/in; a skin soft point of approximately 110 degrees Celsius; and a processing range of greater than 123 degrees Celsius.

It has been found that Delnet® is the preferred adhesive for use in adhesive layer 36 as it does not "lock up" the cotton fibers in first layer 32 and second layer 34, thus allowing the first and second layers to maintain stretchability. Specifically, it has been found that adhesive layer 36 including a net of adhesive strands of yarn (not shown) that cross over each other in a configuration that resembles a diamond shape allows brassiere 10 to maintain its stretch. The diamond can be further identified with dots (not shown) interconnecting the strands. It is believed that when adhesive layer 36 is activated, the corners of the diamond or strands draws back to the crossover dots, which secure first layer 32 to second layer 34. It is also believed that this pulling back of the strands to the dots facilitates first and second layers 32, 34 maintaining their stretch.

Figure 3:
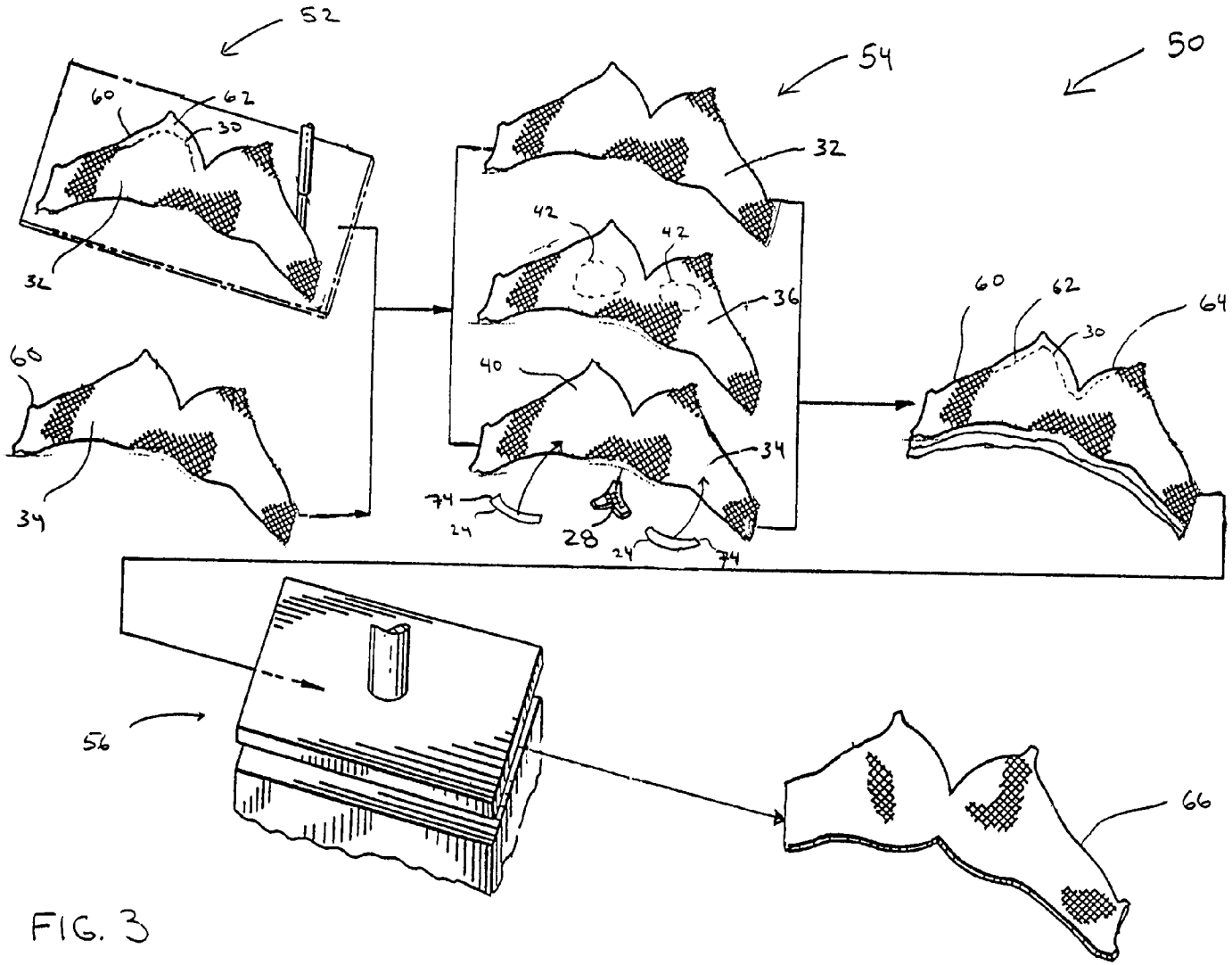
FIGS. 3-4 schematically illustrate a method according to the present invention of forming the brassiere of FIG. 1.
Figure 4:
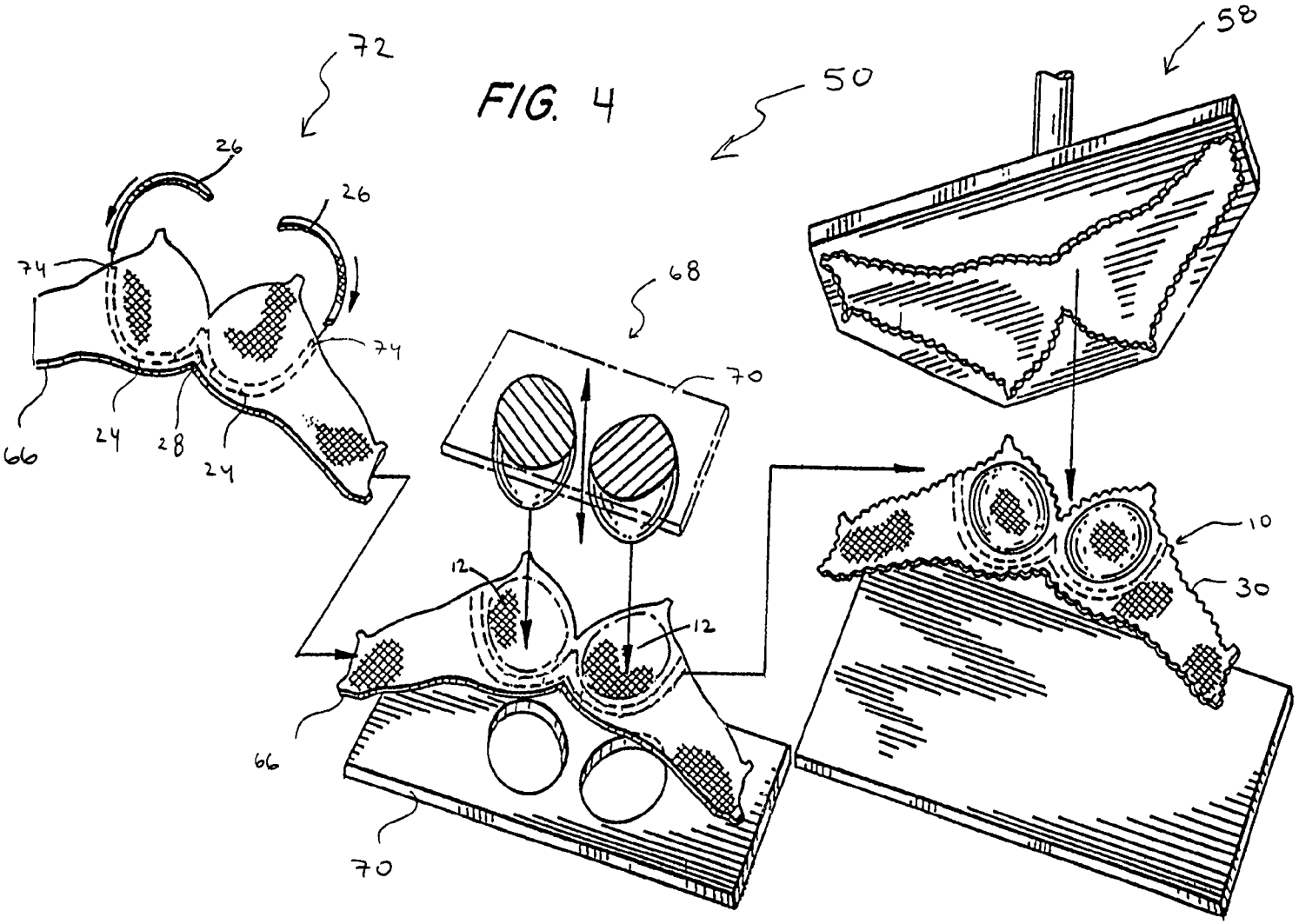

A method 50 of forming brassiere 10 having fabric layers 32, 34 and adhesive layer 36 is shown in FIGS. 3 and 4. Method 50 includes a first or cutting step 52, a second or assembly step 54, a third or activation step 56, and a fourth or trimming step 58.

In the first step 52, first and second fabric layers 32, 34, as well as adhesive layer 36 are cut to a shape 60 that generally follows and approximates the outline of brassiere 10. Shape 60 is slightly larger than finished edge 30 to be defined about the periphery of brassiere 10 so that a selvage or trim 62 remains in the shape for later removal during manufacture.

The individual pieces of brassiere 10 are assembled in second step 54. Specifically, first layer 36 is positioned atop second layer 34, then first layer 32 is positioned atop adhesive layer 36 to form a sub-assembly 64.

Adhesive layer 36 is activated at third step 56 to cause sub-assembly 64 to form a laminate 66. For example, third step 56 can be heat treatment step in which adhesive layer 36 is thermally actuated causing first and second layers 32, 34 to adhere to one another and form laminate 66.

Trim 62 is removed from laminate 66 at fourth step 58 to provide finished edge 30 and, thus, to complete brassiere 10. For example, fourth step 58 can reciprocate a die and press into one another to die cut trim 62 from laminate 66. At this stage, brassiere 10 is fully glued around the perimeter of the garment (e.g., edge 30) and, thus, does not require any additional finishing step to prevent the edge from unraveling. In addition, edge 30 can include the decorative pattern that enhances the aesthetic appeal of brassiere 10 as well allows the brassiere to better engage the body of the wearer. Typically, shoulder straps 20 and interconnecting clasps 22 are attached to brassiere 10 after removal of trim 62.

In some embodiments of the present invention, method 50 can include a fifth or molding step 68. In fifth step 68, laminate 66 can be introduced to a molding machine 70 for molding breast cup portions 12 into the laminate to give the cups a predetermined shape.

In other embodiments of the present invention, method 50 can include a sixth or underwire insertion step 72. During second step 54, channels 24 and gore 28 are assembled into sub-assembly 64. For example, channels 24 are typically stitched to inner surface 40 of second layer 34, but alternatively may be glued or ultrasonically welded to the inner surface. Central gore 28 is then positioned between channels 24. Thus, laminate 66 presented to sixth step 72 includes channels 24 having open ends 74. Sixth step 72 inserts each underwire 26 into each channel 24 through its open end 74. Sixth step 72 then closes open ends 74 by stitching, gluing, or ultrasonic welding.

It should be recognized that sixth step 72 is illustrated by way of example inserting underwires 26 after sub-assembly 64 is exposed to third step 56 to form laminate 66. However, it is contemplated by the present disclosure for sixth step 72 to be prior to third step 56 so that the third step not only forms laminate 66, but also closes open ends 74.

Brassieres constructed from fabric laminates made according to the present invention are highly resistant to unraveling due to the polyethylene and ethylene vinyl acetate copolymer used as an adhesive. This adhesive permits the use of natural fibers, such as cotton, in manufacturing the brassiere as this particular adhesive does not "lock up" the cotton fibers and allows the material to maintain a degree of stretchability. Because of the construction of the fabric laminate, brassieres made from this fabric laminate do not require seams thus giving them an aesthetically pleasing seamless appearance. In addition, such brassieres are easier and less expensive to manufacture as construction involves a minimum of labor intensive assembly steps.

It should be recognized that method 50 is illustrated by way of example as forming brassiere 10. Of course, it is contemplated by the present invention for method 50 to find equal use in the manufacture of other undergarments.

While the present invention has been described with reference to one or more exemplary embodiments, it will be understood by those skilled in the art that various changes may be made and equivalents may be substituted for elements thereof without departing from the scope of the present invention. In addition, many modifications may be made to adapt a particular situation or material to the teachings of the disclosure without departing from the scope thereof. Therefore, it is intended that the present invention not be limited to the particular embodiment(s) disclosed as the best mode contemplated for carrying out this invention, but that the invention will include all embodiments falling within the scope of the appended claims.

What is claimed is:

1. A method of forming a breast covering garment having two breast cups, comprising:

inserting an adhesive layer between a first fabric layer and a second fabric layer to form a fabric sub-assembly, said sub-assembly having a periphery that is larger than an entire outer periphery of the breast covering garment and is shaped to cover both breast cups of the breast covering garment;

causing said adhesive layer to form a laminate from said sub-assembly; and removing a trim from said laminate at said entire outer periphery to form a finished edge of the garment, wherein said first and second fabric layers include a blend of cotton-based material.

2. The method as in claim 1, wherein said blend comprises about 44% to about 50% of said cotton-based material, about 44% to about 50% of a polyester material, and about 3% to about 9% of a spandex material.

3. The method as in claim 2, wherein said blend comprises about 47% of said cotton-based material, about 47% of said polyester material, and about 6% of said spandex material.

4. The method as in claim 1, wherein said finished edge resists unraveling.

5. The method as in claim 1, wherein said finished edge has a shape selected from the group consisting of a straight edge, a scalloped edge, and any combination of the foregoing.

6. The method as in claim 1, wherein said adhesive layer only bonds said first and second fabric layers together in a selected region so that a non-bonded region is formed.

7. The method as in claim 1, wherein said adhesive layer is a layer of thermally actuated polyethylene and ethylene vinyl acetate copolymer.

8. The method as in claim 7, wherein said non-bonded region is a breast cup region.

9. The method as in claim 1, wherein said adhesive layer allows said first fabric layer to bond to said second fabric layer so that said laminate is a stretchable laminate.

10. The method as in claim 1, further comprising inserting a fabric member between said first fabric layer and said adhesive layer.

11. The method as in claim 10, wherein said fabric member is a gore.

12. The method as in claim 10, wherein said fabric member is an underwire channel.

13. The method as in claim 12, further comprising inserting an underwire into said underwire channel before or after causing said adhesive layer to form said laminate.

14. A method of forming a breast covering garment having two breast cups, comprising:

applying an adhesive layer to a first fabric layer, said first fabric layer being a first cotton blend fabric;

overlying said adhesive layer with a second fabric layer, said second fabric layer being a second cotton blend fabric;

causing said adhesive layer to bond said first and second fabric layers together to form a stretchable laminate, said stretchable laminate having a periphery that is larger than an entire outer periphery of the breast covering garment and is shaped to cover both breast cups of the breast covering garment; and cutting said stretchable laminate along said entire outer periphery to form a finished edge of the garment that resists unraveling.

15. The method as in claim 14, wherein said adhesive layer is a layer of thermally actuated polyethylene and ethylene vinyl acetate copolymer.

16. The method as in claim 14, wherein said adhesive layer only bonds said first and second fabric layers together in a selected region so that a non-bonded region is formed.

17. The method as in claim 16, wherein said non-bonded region is a breast cup region.

18. The method as in claim 14, further comprising inserting a fabric member between said first fabric layer and said adhesive layer.

19. A method of forming a breast covering garment having two breast cups, comprising:

forming an adhesive layer having an adhesive free region;

surrounding said adhesive layer with a first fabric layer and a second fabric layer;

causing said adhesive layer to bond said first and second fabric layers together to form a stretchable laminate, said stretchable laminate having a periphery that is larger than an entire outer periphery of the breast covering garment and is shaped to cover both breast cups of the breast covering garment; and cutting said stretchable laminate along said entire outer periphery to form a finished edge of the garment that resists unraveling, wherein said adhesive layer is a layer of thermally actuated polyethylene and ethylene vinyl acetate copolymer.

20. The method as in claim 19, wherein said adhesive free region defines a non-bonded region of said first and second fabric layers.

21. The method as in claim 19, wherein said first and second fabric layers comprise a blend of a cotton material.

22. The method as in claim 21, wherein said blend comprises about 44% to about 50% of said cotton material, about 44% to about 50% of a polyester material, and about 3% to about 9% of a spandex material.

23. The method as in claim 19, wherein said finished edge has a shape selected from the group consisting of a straight edge, a scalloped edge, and any combination of the foregoing.

* * * * *